US009869008B2

(12) United States Patent
Pouget et al.

(10) Patent No.: US 9,869,008 B2
(45) Date of Patent: Jan. 16, 2018

(54) HIGH-TEMPERATURE EFFICIENT ALUMINUM COPPER MAGNESIUM ALLOYS

(75) Inventors: Gaelle Pouget, Grenoble (FR); Christophe Sigli, Grenoble (FR)

(73) Assignee: CONSTELLIUM ISSOIRE, Issoire (FR)

( * ) Notice: Subject to any disclaimer, the term of this patent is extended or adjusted under 35 U.S.C. 154(b) by 784 days.

(21) Appl. No.: 13/446,617

(22) Filed: Apr. 13, 2012

(65) Prior Publication Data

US 2012/0261036 A1 Oct. 18, 2012

Related U.S. Application Data

(60) Provisional application No. 61/475,806, filed on Apr. 15, 2011.

(30) Foreign Application Priority Data

Apr. 15, 2011 (FR) ..... 11 01187

(51) Int. Cl.

| | |
|---|---|
| ***C22C 21/16*** | (2006.01) |
| ***C22F 1/057*** | (2006.01) |
| ***C22C 21/12*** | (2006.01) |

(52) U.S. Cl.

CPC ..... *C22C 21/16* (2013.01); *C22C 21/12* (2013.01); *C22F 1/057* (2013.01)

(58) Field of Classification Search

CPC ..... C22C 21/16; C22C 21/12

(Continued)

(56) References Cited

U.S. PATENT DOCUMENTS 3,826,688 A 7/1974 Levy
4,845,543 A * 7/1989 Okikawa et al. ..... 257/738

(Continued)

FOREIGN PATENT DOCUMENTS

EP 0 038 605 10/1981
EP 0756017 1/1997

(Continued)

OTHER PUBLICATIONS

French Search Report for FR1101187 dated Dec. 20, 2011.

(Continued)

*Primary Examiner* — Rebecca Lee
(74) *Attorney, Agent, or Firm* — McBee Moore Woodward & Vanik IP, LLC; Susan McBee

(57) ABSTRACT

The disclosure provides for wrought products made of Al—Cu—Mg aluminum alloy composed as follows, as a percentage by weight, $Cu_{corr}$: 2,6-3.7; $Mg_{corr}$: 1.5-2.6, Mn: 0.2-0.5; Zr: ≤0.16; Ti: 0.01-0.15; Cr≤0.25; Si≤0.2; Fe≤0.2; other elements <0.05 the rest aluminum; with $Cu_{corr}>-0.9(Mg_{corr})+4.3$ and $Cu_{corr}<-0.9(Mg_{corr})+5.0$; where $Cu_{corr}=Cu-0.74(Mn-0.2)-2.28\ Fe$ and $Mg_{corr}=Mg-1.73(Si-0.05)$ for Si≥0.05 and $Mg_{corr}=Mg$ for Si<0.05 and their manufacturing process.

3 Claims, 4 Drawing Sheets

(58) Field of Classification Search
USPC ..... 148/550, 552, 417, 549
See application file for complete search history.

(56) References Cited

U.S. PATENT DOCUMENTS

| | | | | |
|---|---|---|---|---|
| 5,213,639 | A | 5/1993 | Colvin et al. | |
| 5,593,516 | A | 1/1997 | Cassada, III | |
| 5,738,735 | A | 4/1998 | Bechet | |
| 6,444,058 | B1 | 9/2002 | Liu et al. | |
| 2003/0140990 | A1 | 7/2003 | Ribes et al. | |
| 2010/0314007 | A1* | 12/2010 | Danielou et al. ..... | 148/502 |
| 2011/0056597 | A1* | 3/2011 | Rioja et al. ..... | 148/698 |

FOREIGN PATENT DOCUMENTS

| | | |
|---|---|---|
| FR | 2 279 852 | 2/1976 |
| FR | 2843754 | 2/2004 |
| RU | 2210614 | 8/2003 |
| WO | 94/05820 | 3/1994 |
| WO | 96/29440 | 9/1996 |
| WO | 99/31287 | 6/1999 |

OTHER PUBLICATIONS

"International Alloy Designations and Chemical Composition Limits for Wrought Aluminum and Wrought Aluminum Alloys" The Aluminum Association. Appendix 1. pp. 1-4, 2009.

* cited by examiner

HIGH-TEMPERATURE EFFICIENT ALUMINUM COPPER MAGNESIUM ALLOYS

CROSS REFERENCE TO RELATED APPLICATIONS

This application claims priority to French Patent Application No. 11-01187, filed Apr. 15, 2011; and U.S. Provisional Application No. 61/475,806, filed Apr. 15, 2011, the contents of both of which are incorporated herein by reference in their entireties.

BACKGROUND

Field of the Invention

The invention relates to aluminum-copper-magnesium alloy products, and more particularly such products, their manufacturing processes and use, designed to be used at high temperature.

Description of Related Art

Certain aluminum alloys are regularly used for applications in which they are used at high temperatures, typically between 100 and 200° C., for example as structural parts or as a means of fastening close to engines in the automobile or aerospace industry or as structural parts in supersonic aircraft.

These alloys require good mechanical performance at high temperature. Good mechanical performance at high temperature means in particular both thermal stability, i.e. that the mechanical properties measured at ambient temperature are stable after long-term aging at the application temperature, and also efficiency when hot, i.e. the mechanical properties measured at high temperature (static mechanical properties and creep strength) are high.

Among alloys known for this type of application mention may be made of alloy AA2618 which contains (as a percentage by weight):

Cu: 1.9-2.7 Mg: 1.3-1.8 Fe: 0.9-1.3. Ni: 0.9-1.2 Si: 0.10-0.25 Ti: 0.04-0.10 which was used in manufacturing Concorde.

Patent FR 2279852 by Cegedur Pechiney proposes an alloy with a low iron and nickel content composed as follows (as a percentage by weight):

Cu: 1.8-3 Mg: 1.2-2.7 Si<0.3 Fe: 0.1-0.4 Ni+Co: 0.1-0.4 (Ni+Co)/Fe: 0.9-1.3

The alloy may also contain Zr, Mn, Cr, V or Mo with contents lower than 0.4%, and possibly Cd, In, Sn or Be at less than 0.2% each, Zn at less than 8% or Ag at less than 1%. With this alloy, a substantial improvement of the stress concentration factor Klc is obtained, representing resistance to the propagation of cracks.

The subject of patent application EP 0.756.017 A1 (Pechiney Rhenalu) is an aluminum alloy with high resistance to creep composed as follows (as a percentage by weight):

Cu: 2.0-3.0 Mg: 1.5-2.1 Mn: 0.3-0.7
Fe<0.3 Ni<0.3 Ag<1.0 Zr<0.15 Ti<0.15
with Si such that: 0.3<Si+0.4Ag<0.6
other elements <0.05 each and <0.15 in total.

Patent RU2210614C1 describes an alloy composed as follows (as a percentage by weight)

Cu: 3.0-4.2 Mg: 1.0-2.2 Mn: 0.1-0.8 Zr: 0.03-0.2, Ti: 0.012-0.1. V: 0.001-0.15,
at least one element from among Ni: 0.001-0.25 and Co: 0.001-0.25, the rest aluminum. Alloy AA2219 composed as follows (as a percentage by weight) Cu: 5.8-6.8, Mn: 0.20-0.40, Ti: 0.02-0.10. Zr: 0.10-0.25 V: 0.05-0.15 Mg<0.02 is also known for high temperature applications.

These alloys have, however, inadequate mechanical properties for certain applications and also pose problems of recycling in particular because of the high percentage of iron and/or silicon and/or nickel and/or cobalt and/or vanadium. Al—Cu—Mg Alloys are also known.

U.S. Pat. No. 3,826,688 gives information on an alloy composed as follows (as a percentage by weight), Cu: 2.9-3.7, Mg: 1.3-1.7 and Mn: 0.1-0.4.

U.S. Pat. No. 5,593,516 gives information on an alloy composed as follows (as a percentage by weight), Cu: 2.5-5.5, Mg: 0.1-2.3 within the limit of their solubility i.e. such that Cu is at the most equal to $Cu_{max}$=−0.91 (Mg)+5.59.

Patent application EP 0 038 605 A1 teaches an alloy of composition (in weight %) Cu: 3.8-4.4. Mg: 1.2-1.8 et Mn: 0.3-0.9. au maximum 0.12 Si. 0.15 Fe. 0.25 Zn. 0.15 Ti et 0.10 Cr.

U.S. Pat. No. 6,444,058 teaches a composition of high purity Al—Mg—Cu alloy for which effective values for Cu and Mg are defined, especially by $Cu_{target}$=$Cu_{eff}$+0.74 (Mn−0.2)+2.28 (Fe−0.005) and teaches a composition domain in the diagram $Cu_{eff}$: $Mg_{eff}$ wherein the maximum value for $Mg_{eff}$ is about 1.4 wt. %.

There exists a need for aluminum alloy products with good mechanical performances at high temperature, typically at 150° C., and that are easy to manufacture and recycle.

SUMMARY

A first subject of the invention is a wrought product made of aluminum alloy composed as follows, as a percentage by weight, $Cu_{corr}$: 2.6-3.7
$Mg_{corr}$: 1.5-2.6
Mn: 0.2-0.5
Zr: ≤0.16
Ti: 0.01-0.15
Cr≤0.25
Si≤0.2
Fe≤0.2
elements <0.05
the rest aluminum
with $Cu_{corr}$>−0.9($Mg_{corr}$)+4.3 and $Cu_{corr}$<−0.9($Mg_{corr}$)+5.0
in which $Cu_{corr}$ =Cu−0.74(Mn−0.2)−2.28 Fe and
$Mg_{corr}$=Mg−1.73(Si−0.05) for Si≥0.05 and $Mg_{corr}$=Mg for Si<0.05.

Another subject of the invention is a manufacturing process for a wrought product according to the invention including, successively,

- preparation of a molten metal bath in order to obtain an aluminum alloy composed according to the invention,
- casting said alloy typically in the form of a rolling slab, an extrusion billet, bar or a wire stock,
- optionally homogenizing the product so cast in order to reach a temperature ranging between 450° C. and 520° C.,
- working before solution heat-treatment of the product so obtained,
- solution heat-treatment of the product so worked by heat treatment to reach a temperature ranging between 490 and 520° C. and preferably between 500 and 510° C. for 15 minutes to 8 hours, followed by quenching,
- optionally cold working of the product that has been solution heat treated and quenched, artificial aging in which the product obtained in this way reaches a temperature ranging between 160 and 210° C. and preferably between 175 and 195° C. for 5 to 100 hours and preferably from 10 to 50 hours.

Still another subject of the invention is the use of a wrought product according to the invention in an application in which said product is maintained at temperatures of 100° C. to 200° C. for a significant length of time of at least 200 hours.

DETAILED DESCRIPTION OF A PREFERRED EMBODIMENT

Figure 1:
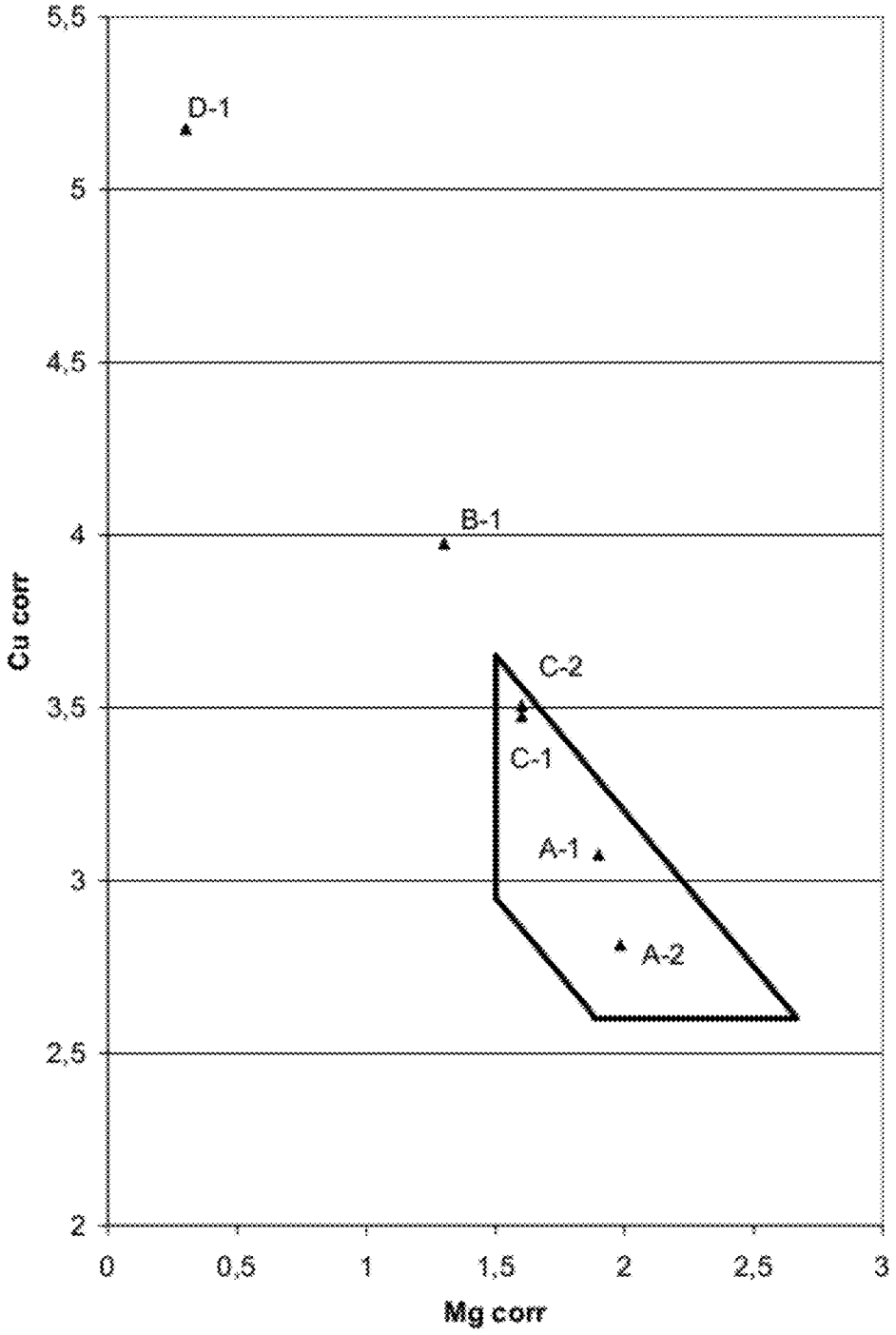
FIG. 1: Representation of the region of composition according to the invention in the plane $Mg_{corr}$:$Cu_{corr}$.

Unless otherwise stated, all the indications concerning the chemical composition of the alloys are expressed as a percentage by weight based on the total weight of the alloy. The expression 1.4 Cu or 1.4 (Cu) means that the copper content expressed as a percentage by weight is multiplied by 1.4. Alloys are designated in conformity with the rules of The Aluminum Association, known to skilled in the art. The definitions of the metallurgical states are indicated in European standard EN 515.

The static mechanical properties under stretching, in other words the ultimate tensile strength $R_m$, the conventional yield stress at 0.2% of elongation $Rp_{0.2}$ and elongation at break A %, are determined by a tensile test according to French standard EN ISO 6892-1, sampling and test direction being defined by standard EN 485-1. Hot tensile tests are performed according to French standard EN 10002-5.The creep tests are carried out according to standard ASTM E139-06.

Unless otherwise specified, the definitions of standard EN 12258 apply.

The present inventors were surprised to note that there exists a region of composition for Al—Cu—Mg alloys containing Mn which makes it possible to obtain wrought products that are particularly efficient at high temperature.

The composition of the wrought products of the invention is defined according to the iron, manganese and silicon content.

The corrected Cu and Mg contents are defined; these are called $Cu_{corr}$ and $Mg_{corr}$ corresponding to the contents of these elements which are not trapped by intermetallic compounds containing iron, manganese or silicon. This correction is important to define the composition range of Cu and Mg of the invention because intermetallic compounds containing iron and manganese formed with copper and intermetallic compounds containing silicon formed with magnesium generally cannot be dissolved. $Cu_{corr}$ and $Mg_{corr}$ therefore correspond to Cu and Mg available after solution heat treatment for forming during aging nanometric phases contributing to hardening.

The corrected contents are obtained using the following equations:

$$Cu_{corr}=Cu-0.74(Mn-0.2)-2.28\ Fe$$

$Mg_{corr}$=Mg 1.73 (Si−0.05) for Si at least equal to 0.05% by weight and $Mg_{corr}$=Mg for a Si content of less than 0.05% by weight.

One can notice that if the Mn content is less than 0.2% by weight, $Cu_{corr}$ is calculated according to $$Cu_{corr}=Cu—Fe\ 2.28$$

To obtain the desired effect on mechanical performance at high temperature, the copper and magnesium contents corrected in this way should preferably obey the following inequalities:

$$Cu_{corr}>-0.9\ (Mg_{corr})+4.3 \text{(preferably } Cu_{corr}>-0.9\ (Mg_{corr})+4.5)$$

$$Cu_{corr}<-0.9\ (Mg_{corr})+5.0$$

The magnesium content advantageously is such that $Mg_{corr}$ lies from 1.5 to 2.6% by weight and preferably from 1.6 to 2.4% by weight.

In an advantageous embodiment of the invention, $Mg_{corr}$ is at least equal to 1.8% by weight and preferably at least equal to 1.9% by weight. This embodiment is particularly advantageous for products in T6 temper.

The copper content is such that $Cu_{corr}$ advantageously is from 2.6 to 3.7% by weight. Advantageously $Cu_{corr}$ is at least 2.7% by weight and preferably at least 2.8% by weight.

From the equations given and the preferred requirements for $Mg_{corr}$ and $Cu_{corr}$, it can be established for some embodiments that an advantageous maximum copper content is 4.33 wt %, corresponding to a corrected $Cu_{corr}$ content=3.65 wt %, obtained for an iron content of 0.2% by weight, a manganese content of 0.5% by weight and a content of corrected $Mg_{corr}$ of 1.5% by weight, corresponding for example to a Mg content of 1.5% by weight and a silicon content of 0.05% by weight. The minimum copper content is 2.6 wt %, corresponding to a corrected content $Cu_{corr}$=2.6 wt. % obtained for an iron content of 0 wt. % and a manganese content of 0.2 wt. %.

The preferred maximum magnesium content is 2.86 wt. % corresponding to a content of $Mg_{corr}$ of 2.6 wt. %, obtained for a Si content of 0.2 wt. %. The minimum magnesium content is advantageously 1.5% by weight, obtained for a Si content of 0% by weight.

One can also note that for a preferred content $Mg_{corr}$ of at least 1.9 wt. % and a maximum content of iron and silicon of 0.08 wt %, the maximum copper content is 3.69 wt % , obtained for a manganese content of 0.5 wt % and corresponding to a corrected content $Cu_{corr}$ of 3.29 wt %.

The corresponding region in the $Mg_{corr}$: $Cu_{corr}$ plane is represented in FIG. 1.

Irrespective of the values of $Mg_{corr}$ and $Cu_{corr}$ an advantageous composition range for product of the invention has a magnesium content of from 1.6 to 2.2 wt. % and preferably from 1.8 to 2.1 wt % and/or a copper content from 2.8 to 3.7 wt. and preferably from 2.9 to 3.4 wt. %.

The products according to the invention preferably contain 0.2 to 0.5% by weight of manganese which in particular contributes to controlling the grain structure. The present inventors noted that the simultaneous addition of manganese and zirconium is advantageous in still further improving control of the grain structure. Advantageously, the Zr content is advantageously at least equal to 0.07% by weight and preferably at least equal to 0.08% by weight. In an advantageous embodiment, the products according to the invention contain 0.09 to 0.15% of zirconium by weight and 0.25 to 0.45% of manganese by weight.

The chromium content is preferably a maximum of 0.25% by weight. In one embodiment of the invention, the chromium content ranges between 0.05 and 0.25% by weight and may in particular contribute to controlling the grain structure. However, the presence of chromium may pose recycling problems and quench sensitivity problems, especially for products having a thickness of at least 50 mm. In another embodiment, the chromium content is less than 0.05% by weight.

The titanium content advantageously lies from 0.01 to 0.15% by weight. The addition of titanium contributes in particular to refining the grains during casting. In one embodiment, it is preferred to keep the addition of titanium to a maximum of 0.05% by weight. More substantial refining may however prove to be useful. So in another embodiment of the invention, the titanium content is from 0.07 to 0.14% by weight.

The iron and silicon contents are preferably each at the most 0.2% by weight. In an advantageous embodiment of the invention, the iron and/or silicon contents are at the most 0.1% by weight and preferably 0.08% by weight. The equations for calculating $Cu_{corr}$ and $Mg_{corr}$ take into account changes of Fe and Si, and to reach an identical value $Cu_{corr}$ more copper can be added when the iron content increases.

The content of the other elements is preferably less than 0.05% by weight. The rest is aluminum.

The wrought products according to the invention can be any wrought products and are typically plates, profiles, bars or wires, but may also be screws, bolts or rivets.

The manufacturing process for the products according to the invention advantageously may include the successive steps of preparing the alloy, casting, optionally homogenization, working, solution heat-treatment, quenching, optionally cold working and aging. Any suitable manufacturing process can be utilized as desired.

In one embodiment, in a first step, a molten metal bath is produced in order to obtain an aluminum alloy composed according to the invention. The molten metal bath is then cast typically in the form of a rolling slab, extrusion billet, bar or wire stock.

Advantageously, the product so cast is then homogenized in order to reach a temperature ranging from 450° C. to 520° and preferably from 500° C. to 510° C. for a length of time ranging from 5 to 60 hours. The homogenization treatment can be carried out in one or more steps.

The product is then worked typically by rolling, extruding and/or drawing and/or wiredrawing and/or hand forging.

The product worked in this way is then subjected to heat treatment to reach a temperature ranging from 490 to 520° C. and preferably from 500 to 510° C. for 15 minutes to 8 hours, followed by quenching.

The quality of the solution heat treatment can be assessed by calorimetry and/or optical microscopy. The objective is that the Cu and Mg are preferably in solid solution with the exception of Cu and Mg bound in intermetallic compounds containing manganese iron and/or silicon.

The product may then optionally undergo cold working

Finally, aging is performed in which the product reaches a temperature ranging from 160 to 210° C. and preferably from 175 to 195° C. for 5 to 100 hours and preferably from 10 to 50 hours. Artificial aging may be performed in one or more steps. Preferably, aging conditions are determined so that the mechanical resistance Rp0.2 is a maximum ("peak" aging).

There are two main embodiments of a suitable process according to the invention depending on the shape of the wrought products. A first embodiment of the process according to the invention makes it possible to manufacture plates or profiles. A second embodiment of the process according to the invention makes it possible to manufacture wire or bars, such as in particular for machining stock, forging stock, bolt stocks, rivet wires, screw stocks and also bolts, screws and rivets.

The first embodiment of the process according to the invention includes the successive steps of preparing the alloy, casting in the form of slabs or billets, optionally homogenization, hot working, solution heat-treatment, quenching, optionally cold working and aging.

In the first embodiment of the process according to the invention the molten metal bath is cast in the form of a rolling slab or extrusion billet.

The optionally homogenized rolling slab or the extrusion billet is then hot worked by rolling or extruding. Hot working in the first embodiment is carried out in order to maintain a temperature of at least 300° C. Advantageously, a temperature of at least 350° C. and preferably at least 380° C. is maintained during the hot working In the first embodiment of the process according to the invention no significant cold working is carried out, in particular by cold rolling, between the hot working and the solution heat-treatment. Such a cold working step would be likely to lead to a recrystallized structure which is undesirable within the framework of the invention for worked products in the form of plates or profiles. Significant cold working is typically working of at least approximately 5%.

The plate or the profile obtained in this way is then subjected to heat treatment to reach a temperature ranging from 490 to 520° C. and preferably from 500 to 510° C. for 15 minutes to 8 hours, followed by quenching typically with water.

The combination of the chosen composition, in particular the manganese content, and the transformation range, in particular the hot working temperature and the absence of significant cold working before solution heat-treatment, make it possible to obtain plates or profiles having a substantially unrecrystallized grain structure. "Substantially unrecrystallized grain structure" is taken to mean an unrecrystallized structure rate at mid-thickness greater than 70% and preferably greater than 85%.

The plate or the profile obtained can then optionally undergo cold working. Advantageously, the cold working is controlled stretching with permanent elongation of 2 to 5% making it possible to improve the mechanical resistance and to obtain a T8 temper after aging.

In the absence of cold working or when the effect of cold work may not be improve mechanical property, a product in T6 temper is obtained after aging.

The plates and profiles obtained according to the first embodiment of the process according to the invention have the advantage of having high mechanical resistance and perform well at high temperature. In this way plates and profiles according to the invention have in T8 temper in the longitudinal direction a yield stress $R_{p0.2}$ of preferably at least 440 MPa, more preferably at least 450 MPa, and preferably still, 455 MPa. For profiles according to the invention in T8 temper a yield stress in the longitudinal direction $R_{p0.2}$ of at least 470 MPa can advantageously be obtained. After aging at 150° C. for 2000 hrs, the reduction in the yield stress of plates and profiles in T8 temper according to the invention in the longitudinal direction is advantageously less than 12%, preferentially less than 10% and preferably less than 8%.

Extruded profiles according to the invention have in T8 temper a yield stress measured at 150° C. in the longitudinal direction of advantageously at least 370 MPa and preferably of at least 380 MPa.

In T6 temper, the plates or profiles made in the embodiment in which the Mg content such that $Mg_{corr}$ is preferably at least equal to 1.8% by weight have a yield stress measured at 150° C. in the longitudinal direction of advantageously at least 340 MPa and a reduction in yield stress after 2000 hrs of aging at 150° C. of less than 5%.

The second embodiment of a suitable process according to the invention includes the successive steps of preparing the alloy, cast in the form of a wire or bar stock, optionally homogenization, hot and/or cold working by extrusion and/or drawing and/or wiredrawing and optionally by later hand forging the wire or bar obtained to obtain screws, bolts or rivets, solution heat-treatment, quenching and aging.

In the second embodiment of one advantageous process according to the invention, the molten metal bath is cast in the form of a wire or bar stock, preferably on a casting wheel, typically with the continuous casting process known by the name of "Properzi". The wire or bar stock may also be an extrusion billet.

The wire or bar stock is then hot and/or cold worked by extrusion and/or drawing and/or wiredrawing. In particular, if the wire or bar stock is an extrusion billet, it will be hot extruded before being cold worked by drawing and/or wiredrawing, while if the wire or bar stock was obtained by continuous casting and hot worked at the exit of the casting wheel, it will generally only be necessary to cold work it.

Optionally, the wire or the bar obtained can be at this stage had forged to obtain screws, bolts or rivets.

The product obtained in this way is then subjected to heat treatment to reach a temperature ranging from 490 to 520° C. and preferably from 500 to 510° C. for 15 minutes to 8 hours, followed by quenching typically with water.

The combination of the chosen composition, in particular the manganese content, and of the working carried out makes it possible to obtain in the second embodiment of the process according to the invention products having a substantially recrystallized grain structure. Substantially recrystallized structure is taken to mean a recrystallization rate of at least 80% and preferably a structure with fine grains of homogeneous size.

The product obtained may then optionally undergo cold working

However, in the manufacture of certain products, such as bolts in particular, screws and rivets, it is difficult to carry out cold working after solution heat-treatment and quenching. Advantageously, the product does not undergo cold working after solution heat-treatment and quenching, and after aging a T6 temper is obtained. A particularly advantageous alloy for the T6 temper has a Mg content such that Mgcorr is at least equal to 1.8% by weight.

On the other hand, the manufacture of products such as wire, bolts, rivets, screws, in a T8 temper and having a substantially recrystallized grain structure made in an alloy of the invention is advantageous.

The products obtained according to the second embodiment of the method of the present invention advantageously exhibit in a T8 temper in the longitudinal direction a yield stress $R_{p0.2}$ of at least 460 MPa, preferably at least 480 MPa and after aging at 150° C. for 2000 h, a decrease of yield strength in the longitudinal direction of less than 10%, preferably less than 8%.

The products according to the invention are particularly useful for applications in which the products are maintained at temperatures of 100° C. to 200° C., typically at approximately 150° C., for a significant length of time of at least 200 hours and preferably of at least 2000 hours.

In this way, the products according to the invention are useful for fastening parts designed to be used in an engine typically for a car, such as screws or bolts or rivets. The products according to the invention are also useful for the manufacture of parts of aircraft nacelles and/or engine poles. Nacelle refers to all the supports and hoods of an aircraft with several engines. The products according to the invention are also useful for the manufacture of leading edges of aircraft wings. The products according to the invention are also useful for the manufacture of fuselages for supersonic aircraft.

These aspects, as well as others of the invention are explained in greater detail using the following illustrative and non-restrictive examples.

EXAMPLE 1

In this example 4 alloys were cast in the form of slabs of dimension 70×170×27 mm. The composition of alloys A-1 and C-1 is as according to the invention.

The composition of the alloys is given in table 1.

TABLE 1

| | composition (% by weight) | | | | | | | | |
|---|---|---|---|---|---|---|---|---|---|
| Alloy | Si | Fe | Cu | Mn | Mg | Ti | Zr | $Cu_{corr}$ | $Mg_{corr}$ |
| A-1 (Inv.) | 0.04 | 0.05 | 3.3 | 0.34 | 1.9 | 0.02 | 0.11 | 3.1 | 1.9 |
| C-1 (Inv.) | 0.04 | 0.05 | 3.7 | 0.34 | 1.6 | 0.02 | 0.11 | 3.5 | 1.6 |
| B-1 (Ref.) | 0.04 | 0.05 | 4.2 | 0.34 | 1.3 | 0.02 | 0.11 | 4.0 | 1.3 |
| D-1 (Ref.) | 0.04 | 0.05 | 5.4 | 0.35 | 0.3 | 0.02 | 0.11 | 5.2 | 0.3 |

Inv.: Invention -
Ref.: Reference

The slabs were homogenized at a temperature ranging between 500° C. and 540° C., adapted according to the alloy, hot rolled to a thickness of 15 mm, solution heat-treated at a temperature ranging between 500° C. and 540° C., adapted according to the alloy, quenched with water by immersion, stretched by 3 to 4% and aged at 190° C. to reach the peak of yield stress under stretching at T8 temper. Thus the plate alloy A-1 was homogenized in two steps of 10 h at 500° C. and 20 h at 509° C., the plate obtained after rolling being solution heat treated for 2 h at 507° C. and aged 12 h at 190° C. The alloy plate B-1 was homogenized in two steps of 10 h at 500° C. and 20 h at 503° C., the plate obtained after rolling being solution heat treated for 2 h at 500° C. and aged 8 hours at 190° C. The plate alloy C-1 was homogenized in two steps of 10 h to 500° C. and 20 h at 503° C., the plate obtained after rolling being solution heat treated for 2 h at 504° C. and aged 12 h at 190° C. The alloy plate D-1 was homogenized in two steps of 10 h to 500° C. and 20 h at 536° C., the plate obtained after rolling being solution heat treated for 2 h at 535° C. and aged 8 h at 190° C.

The resulting plates had a substantially unrecrystallized structure.

The plates obtained in this way were characterized in the longitudinal direction before and after aging at several temperatures and for several durations. The results are given in Table 2.

TABLE 2

| Mechanical properties in the L direction obtained at mid thickness before and after aging (MPa) | | | | | | | | | |
|---|---|---|---|---|---|---|---|---|---|
| Aging temperature | Duration of aging | A-1 | | C-1 | | B-1 | | D-1 | |
| (° C.) | (H) | $R_{0.2}$ | Rm | $R_{0.2}$ | Rm | $R_{0.2}$ | Rm | $R_{0.2}$ | Rm |
| No aging | | | 476 | 468 | 485 | 470 | 483 | 385 | 447 |
| 150 | 500 | 450 | 471 | 471 | 487 | 451 | 488 | 379 | 442 |
| 150 | 1000 | 447 | 467 | 462 | 484 | 427 | 472 | 372 | 438 |
| 150 | 2000 | 436 | 467 | 440 | 473 | 411 | 463 | 375 | 450 |
| 150 | 5000 | 421 | 455 | 424 | 466 | 386 | 449 | 352 | 431 |
| 200 | 500 | 355 | 398 | 353 | 417 | 312 | 365 | 288 | 375 |
| 200 | 1000 | 340 | 405 | 332 | 404 | 295 | 380 | 273 | 360 |
| 200 | 2000 | 314 | 380 | 308 | 381 | 264 | 355 | 261 | 352 |
| 200 | 5000 | 274 | 360 | 269 | 358 | 221 | 316 | 245 | 333 |
| 250 | 200 | 305 | 382 | 301 | 374 | 263 | 354 | 262 | 352 |
| 250 | 400 | 245 | 335 | 235 | 327 | 203 | 300 | 234 | 324 |
| 250 | 600 | 176 | 284 | 163 | 265 | 145 | 252 | 222 | 314 |
| 250 | 800 | 150 | 265 | 136 | 246 | 109 | 222 | 215 | 311 |

Figure 2A:
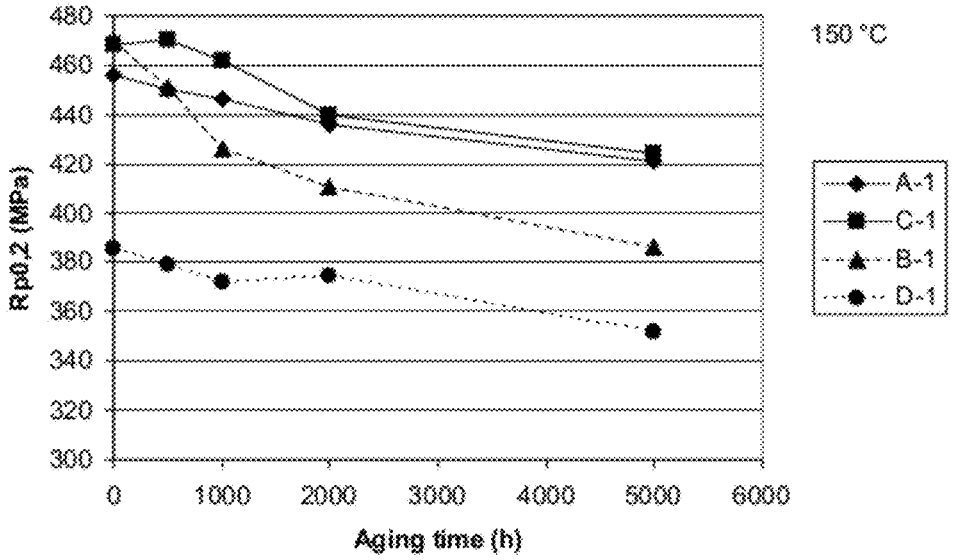
FIG. 2*a:* aging at 150° C., FIG. 2*b:* aging at 200° C., FIG. 2*c:* aging at 250° C.
Figure 2B:
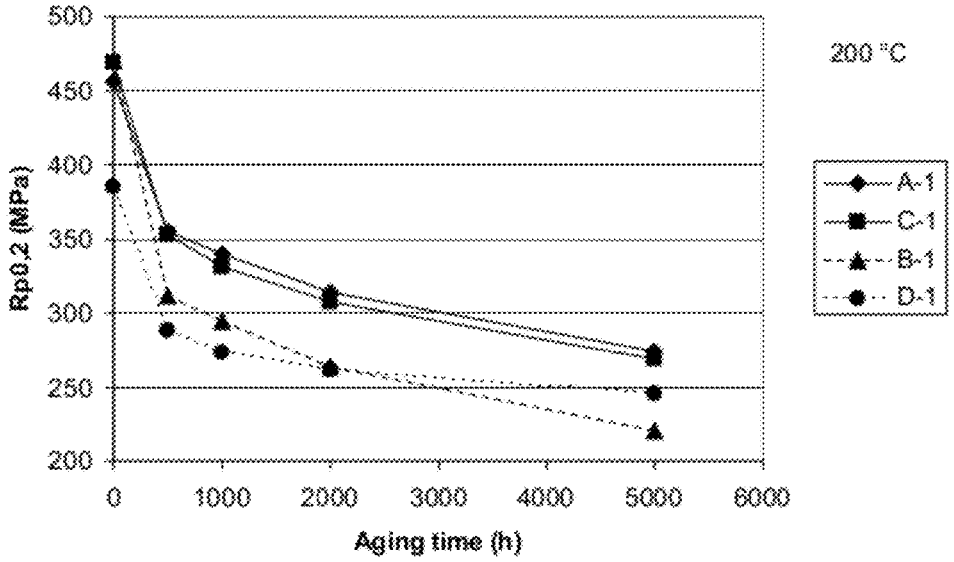
FIG. 2: Changes in the yield stress $R_{p0.2}$ with aging time for the flat-rolled products in example 1.
Figure 2C:
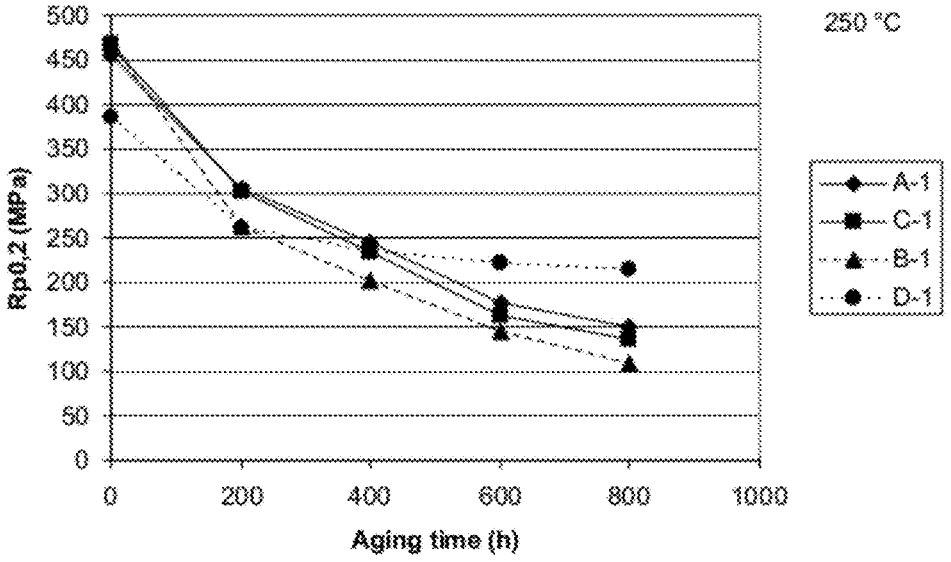

The changes in mechanical properties with the duration of aging for the various temperatures examined are shown in FIGS. 2*a* to 2*c*. It is noted that for an aging temperature of 200° C., the plates according to the invention (A-1 and C-1) have, for 2000 hrs aging a yield stress improved by more than 15% as compared to reference plates (B-1 and D-1).

EXAMPLE 2

In this example two alloys were cast in the form of billets of diameter 200 mm. The composition of alloys A-2 and C-2 is as according to the invention.

The compositions are given in table 3.

TABLE 3

| composition (% by weight) | | | | | | | | | |
|---|---|---|---|---|---|---|---|---|---|
| Alloy | Si | Fe | Cu | Mn | Mg | Ti | Zr | $Cu_{corr}$ | $Mg_{corr}$ |
| A-2 (Inv.) | 0.06 | 0.04 | 3.0 | 0.33 | 2.0 | 0.02 | 0.10 | 2.8 | 2.0 |
| C-2 (Inv.) | 0.04 | 0.04 | 3.7 | 0.34 | 1.6 | 0.02 | 0.11 | 3.5 | 1.6 |

Inv.: Invention

The billets were homogenized at a temperature ranging between 500° C. and 520° C., adapted according to the alloy and extruded to obtain cylindrical bars of diameter 13 mm, solution heat-treated at a temperature ranging between 500° C. and 520° C., adapted according to the alloy, and quenched with water. Thus the billet made of alloy A-Z was homogenized 24 h at 508° C. and the bars obtained were solution heat treated 1 h at 506° C. The billet made of alloy C-2 was homogenized 24 h at 508° C. and the bars obtained were solution heat treated 1 h at 503° C. Certain bars were stretched by 3 to 4%; other bars were not stretched; all the bars finally underwent peak aging to obtain a T6 temper (unstretched; 20 h at 190° C. for A-2 and 16 h at 190° C. for C-2) or T8 (stretched, 12 h at 190° C. for both alloys). The profiles so obtained exhibited a substantially unrecrystallized grain structure.

For reference, alloy 6056 wires were used in T6 temper with a diameter of 12 mm and alloy 2618 bars in T8 temper of diameter 40 mm.

The mechanical properties in the longitudinal direction before and after aging at 150° C. are given in Table 3.

TABLE 4

| Mechanical properties at mid-diameter in the L direction | | | | | |
|---|---|---|---|---|---|
| Aging time (H) at 150° C. | Alloy | Metallurgical temper | $R_{p0.2}$ (MPa) | $R_m$ (MPa) | Elongation % |
| 0 | A-2 | T8 | 514 | 538 | 10 |
| 0 | C-2 | T8 | 476 | 510 | 11 |
| 0 | 2618 | T8 | 434 | 459 | 8 |
| 0 | A-2 | T6 | 397 | 478 | 11 |
| 0 | C-2 | T6 | 402 | 492 | 12 |
| 0 | 6056 | T6 | 378 | 412 | 15 |
| 1000 | A-2 | T8 | 480 | 515 | 11 |
| 1000 | C-2 | T8 | 467 | 507 | 12 |
| 1000 | 2618 | T8 | 415 | 447 | 9 |
| 1000 | A-2 | T6 | 393 | 471 | 11 |
| 1000 | C-2 | T6 | 363 | 455 | 13 |
| 1000 | 6056 | T6 | 375 | 397 | 13 |
| 2000 | A-2 | T8 | 453 | 491 | 4 |
| 2000 | C-2 | T8 | 447 | 491 | 5 |
| 2000 | 2618 | T8 | 402 | 439 | 4 |
| 2000 | A-2 | T6 | 399 | 468 | 5 |
| 2000 | C-2 | T6 | 332 | 429 | 6 |
| 2000 | 6056 | T6 | 359 | 384 | 6 |

Figure 3A:
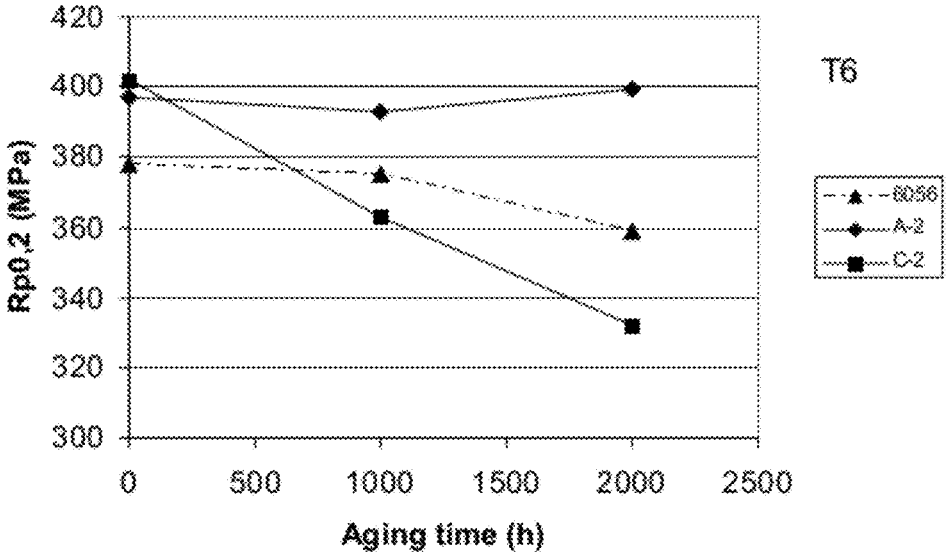
FIG. 3*a:* temper T6, FIG. 3*b:* temper T8.
Figure 3B:
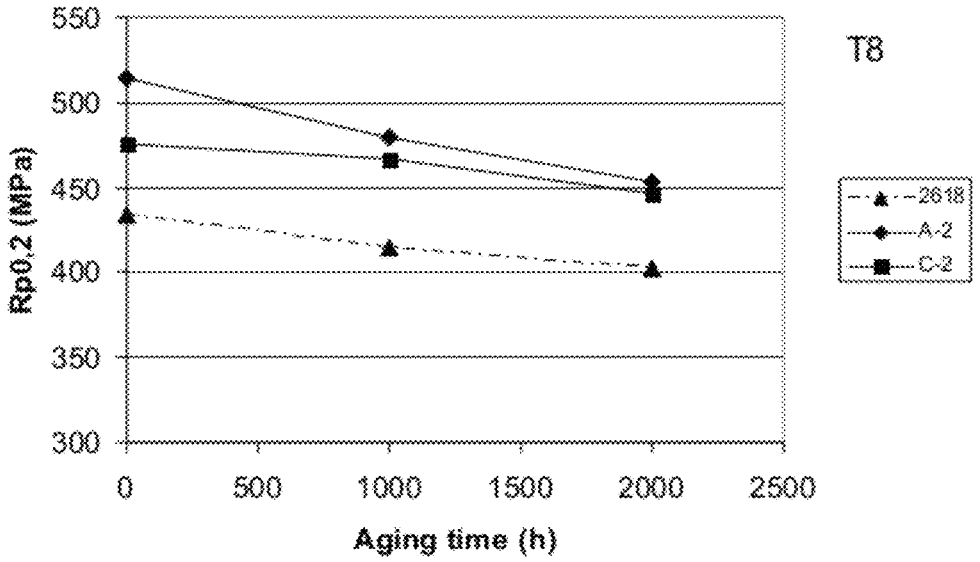
FIG. 3: Changes in the yield stress $R_{p0.2}$ with aging time at 150° C. for the extruded products in example 2.

These results are also presented in FIGS. 3*a* and 3*b*. In temper T6, alloy A-2 is particularly stable thermally.

Characterization tests under stretching at a temperature of 150° C. were also carried out according to standard NF EN 10002-5.

The results are given in Table 4.

TABLE 5

| Characterization of mechanical properties at 150° C. in the L direction | | | | |
|---|---|---|---|---|
| Alloy | Temper | $R_{p0.2}$ (MPa) | $R_m$ (MPa) | Elongation % |
| 6056 | T6 | 333 | 343 | 16 |
| A-2 | T6 | 349 | 412 | 18 |
| C-2 | T6 | 338 | 405 | 18 |
| 2618 | T8 | 357 | 390 | 14 |
| A-2 | T8 | 398 | 420 | 17 |
| C-2 | T8 | 385 | 413 | 17 |

It is noted that the products according to the invention have, in particular, a breaking strength that is clearly higher than that of the reference products used conventionally, such as alloy 6056 (T6) or alloy 2618 (T8).

Creep tests were carried out according to standard ASTM E139-06 for a stress of 285 MPa and at a temperature of 150° C. In particular the lifespan, bending after 200 hrs and the stationary creep speed were measured. The results are given in Table 5.

TABLE 6

L direction

| | | Creep | | Bending after 200 h (%) | | Stationary creep | |
|---|---|---|---|---|---|---|---|
| | | lifespan (H) | | ts. | ts. | speed (s−1) | |
| Alloy | Temper | ts. n° 1 | ts n° 2 | n° 1 | n° 2 | ts. n° 1 | ts. n° 2 |
| 6056 | T6 | 310 | 393 | 0.30 | 0.30 | 3.3E−09 | 3.7E−09 |
| A-2 | T6 | 377 | 458 | 0.47 | 0.50 | 6.6E−09 | 6.7E−09 |
| C-2 | T6 | 487 | 730 | 0.51 | 0.43 | 6.5E−09 | 5.5E−09 |
| 2618 | T8 | 343 | 283 | 0.89 | 1.41 | 1.1E−08 | 1.5E−08 |
| A-2 | T8 | >827.9 | >779.9 | 0.25 | 0.40 | 1.9E−09 | 2.8E−09 |
| C-2 | T8 | >825.2 | >817.8 | 0.26 | 0.26 | 4.1E−09 | 3.8E−09 |

ts: test specimen

EXAMPLE 3

In this example a cylindrical bar 13mm in diameter of alloy C-2 was obtained by hot extrusion from a billet homogenized 24 h at 508° C. The bar was then cold drawn to obtain a wire 10.55 mm in diameter. The wire thus obtained was solution heat treated 1 hour at 503° C., stretched from 3 to 4% and aged 12 h at 190° C. to obtain a T8 temper.

The grain structure of the wire thus obtained, as observed particularly in a TLxTC section at half thickness, was substantially recrystallized and showed a fine and homogeneous grain.

The mechanical properties obtained in the longitudinal direction before and after aging at 150° C. are given in Table 7.

TABLE 7

Mechanical properties The mid-direction diameter of the wire of diameter 10.55 mm

| Aging time (h) at 150° C. | Alloy | Temper | $R_{p0,2}$ (MPa) | $R_m$ (MPa) | Elongation % |
|---|---|---|---|---|---|
| 0 | C-2 | T8 | 503 | 522 | 7.8 |
| 1000 | C-2 | T8 | 462 | 494 | 6.9 |
| 2000 | C-2 | T8 | 471 | 508 | 7.7 |
| Measure at 150° C. | C-2 | T8 | 397 | 428 | |

The invention claimed is:

1. A wrought product comprising an aluminum alloy consisting essentially of, as a percentage by weight, $Cu_{corr}$: 2.6-3.7
$Mg_{corr}$: 1.5-2.6
Mn: 0.2-0.5
Zr: ≤0.16
Ti: 0.01-0.15
Cr ≤0.25
Si ≤0.2
Fe ≤0.2
other elements <0.05
remainder aluminum wherein $Cu_{corr} > -0.9(Mg_{corr})+4.3$ and $Cu_{corr} < -0.9(Mg_{corr})+5.0$ in which $Cu_{corr} = Cu - 0.74(Mn - 0.2) - 2.28\ Fe$ and $Mg_{corr} = Mg - 1.73(Si - 0.05)$ for $Si \geq 0.05$ and $Mg_{corr} = Mg$ for $Si < 0.05$;

wherein said wrought product is aged such that the mechanical resistance $R_{p0.2}$ is a maximum;

and wherein said wrought product is a wire or bar or screw or bolt or rivet having a substantially recrystallized grain structure.

2. The wrought product according to claim 1, wherein said wrought product is present in a T8 temper and has a tensile yield stress $R_{p0,2}$ in a longitudinal direction, of at least 460 MPa, and after aging at 150° C. for 2000 hours, a decrease of tensile yield stress in a longitudinal direction of less than 10%.

3. The wrought product of claim 1, wherein said substantially recrystallized grain structure comprises a recrystallization rate of at least 80%.

* * * * *